US006786008B2

(12) United States Patent
Brochu

(10) Patent No.: US 6,786,008 B2
(45) Date of Patent: Sep. 7, 2004

(54) EAVES TROUGH WITH A GUTTER SHIELD

(76) Inventor: Stephane Brochu, 890 Beaulieu St., St.-Jean-Chrysostome, Quebec (CA), G6Z 2L1

( * ) Notice: Subject to any disclaimer, the term of this patent is extended or adjusted under 35 U.S.C. 154(b) by 46 days.

(21) Appl. No.: 10/261,043

(22) Filed: Sep. 30, 2002

(65) Prior Publication Data

US 2004/0060244 A1 Apr. 1, 2004

(51) Int. Cl.[7] ..... E04H 3/12
(52) U.S. Cl. ..... 52/12; 248/48.1
(58) Field of Search ..... 52/12, 11, 13; 248/48.1

(56) References Cited

U.S. PATENT DOCUMENTS 5,216,852 A * 6/1993 Bemis et al. ..... 52/12
6,134,843 A * 10/2000 Tregear ..... 52/12
6,427,388 B1 * 8/2002 Brochu ..... 52/12

FOREIGN PATENT DOCUMENTS

JP 402058664 A * 2/1990 ..... 52/12

* cited by examiner

*Primary Examiner*—Carl D. Friedman
*Assistant Examiner*—Naoko Slack
(74) *Attorney, Agent, or Firm*—Eric Fincham

(57) ABSTRACT

A gutter guard for protecting a gutter, the guard member having an elongated configuration with a generally planar central portion having a plurality of apertures extending therethrough, first and second longitudinally extending opposed sides located on either side of the planar central portion, a first side of a guard member having an upwardly extending portion designed to fit within a recess formed in the gutter, while the second side of the guard member has an inverted U-shaped portion designed to fit over an upper marginal edge of the rear wall of the gutter. This arrangement permits direct attachment of the gutter to the adjacent wall of the structure to which it is attached through the inverted U-shaped portion. In one embodiment, an intrical one-piece gutter guard and gutter is provided.

11 Claims, 4 Drawing Sheets

EAVES TROUGH WITH A GUTTER SHIELD

FIELD OF THE INVENTION

The present invention relates to an eaves trough or gutter assembly and more particularly, relates to improvements to such structures.

BACKGROUND OF THE INVENTION

The use of shields or gutters or eaves troughs is well known in the prior art and there have been many proposals for different types of shields. The purpose of the shield is essentially to permit passage of rainwater from the roof to the eaves trough while protecting the same from extraneous foreign matter such as leaves and the like.

To-date, there have been several different approaches taken. A first approach is utilizing a shield or a guard which is apertured and permits the passage of rainwater while extensively barring the passage of extraneous material. Moreover, many of these guards do not function as desired and access must still be had to the eaves trough for cleaning purposes.

It has also been proposed in the art to provide relatively complex structures wherein eaves troughs are mounted for rotatable movement such that they may be emptied at desired intervals.

There have also been proposals in the art for gutters and eaves troughs which have a design wherein a cover has an outer edge which curls downwardly and the water flow follows a curved portion due to surface tension and thereafter cascades into the eaves trough. However, this concept suffers that when the volume of water becomes sufficiently large, the surface tension is insufficient to cause all the water to flow into the gutter.

SUMMARY OF THE INVENTION

It is an object of the present invention to provide a novel gutter guard which is adapted to be used with existing gutters and which will eliminate the use of conventional attachment procedures for securing the gutter to the eaves of the structure.

It is a further object of the present invention to provide a novel eaves trough having an integrated gutter guard and which eliminates the need for conventional attachment of the gutter using long nails and the like.

According to one aspect of the present invention, there is provided a device for protecting a gutter wherein the gutter has a rear wall, a front wall, and a bottom wall, the walls defining a trough having an open top therebetween, the gutter also having a top wall portion extending inwardly from an upper marginal edge of the front wall, and a downwardly extending flange from a distal end of the top wall, the front wall, the top wall and the flange defining a recess therebetween, the device comprising a guard member having an elongated configuration with a generally planar central portion, first and second longitudinally extending opposed sides located on either side of the generally planar central portion, a plurality of apertures extending through the generally planar central portion, the first side of the guard member having an upwardly extending portion designed to fit within the recess, and the second side of the guard member having an inverted U-shaped portion designed to fit over an upper marginal edge of the rear wall of the gutter.

According to a further aspect of the invention, there is provided an eaves trough formed from a single piece of material, the eaves trough comprising a rear wall, a front wall, and a bottom wall, the walls defining a trough therebetween, a top wall extending inwardly from a distal end of the front wall, a downwardly extending inner wall portion extending from a distal end of the top wall, and a substantially planar horizontal portion covering the trough, a distal end of the substantially horizontal portion having an inverted U-shaped configuration sized and arranged to fit over an upper marginal portion of the rear wall.

According to a further aspect of the invention, there is provided, in a building having a gutter for collecting water, the improvement wherein the gutter has a rear wall, a front wall, and a bottom wall, the walls defining an open trough therebetween, the gutter also having a top wall portion extending inwardly from an upper marginal edge of the front wall, and a downwardly extending flange from a distal end of the top wall, the front wall, the top wall and the flange defining a recess therebetween, a guard member having an elongated configuration with a generally planar central portion, first and second longitudinally extending opposed sides located on either side of the generally planar central portion, a plurality of apertures extending through the generally planar central portion, the first side of the guide member having an upwardly extending portion designed to fit within the recess, the second side of the guide member having an inverted U-shaped configuration fitting over an upper marginal edge of the rear wall of the gutter, and the gutter being attached by a fastening means extending through the inverted U-shaped portion and the rear wall of the gutter to the building structure.

The device of the present invention may be formed of any suitable material and would conveniently be formed either of a metallic or plastic material. Thus, both materials are known for use in gutters and one may use either a similar or dissimilar material.

The device of the present invention provides a guard for the eaves trough to prevent foreign matter from entering into the eaves trough. It is important that appropriate sizing of the apertures formed in the planar protection is provided. Thus, the aperture size and their placement permit adequate drainage of the water through the apertures into the eaves trough while substantially excluding any foreign matter which remains on the top and would normally be removed by the wind or the like. The specific sizing of the apertures can also prevent clogging of the device.

The apertures preferably extend in diagonal rows at an angle of 45° with respect to the gutter length. In the preferred embodiments, the apertures have an aperture size of between 2.5 and 10 mm and even more preferably between about 3.0 and 4.0 mm. As the apertures are arranged in diagonal rows, they are also preferably arranged in longitudinally extending rows. In a longitudinally extending row, the apertures are spaced apart by a distance between 10 and 15 mm while in a diagonal row, they are spaced apart by a distance of between 5 and 10 mm.

As will be appreciated, during a period of heavy rain or the like, the drainage may not be instantaneous and accordingly, there is provided a vertically extending adjacent front wall gutter to prevent overflow.

BRIEF DESCRIPTION OF THE DRAWINGS

Having thus generally described the invention, reference will be made to the accompanying drawings illustrating an embodiment thereof, in which.

DETAILED DESCRIPTION OF THE PREFERRED EMBODIMENTS

Figure 1:
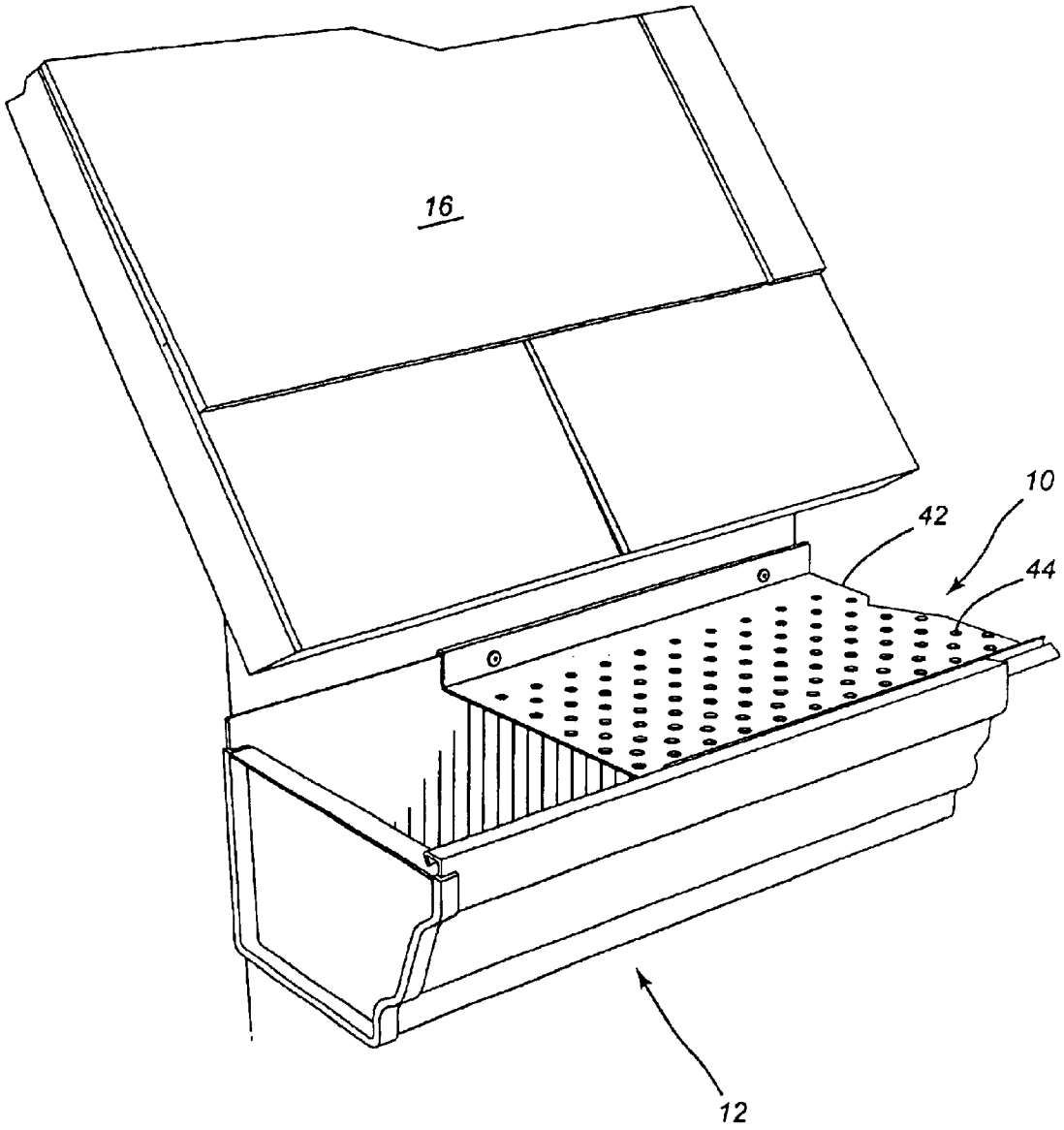
FIG. 1 is a perspective view, partially in cut away, illustrating one embodiment of a gutter guard according to the present invention.

Referring to the drawings in greater detail and by reference characters thereto, there is illustrated in FIG. 1 a gutter guard according to one embodiment of the present invention and which gutter guard is generally designated by reference numeral 10. Gutter guard 10 is used in conjunction with an eaves trough 12 which lies adjacent the facia of a roof 16.

Eaves trough or gutter 12 is of a substantially conventional structure and has a rear wall 20, a bottom wall 22, and a front wall generally designated by reference numeral 24, the walls defining therebetween a trough to receive rain run off from roof 16. Front wall 24 includes a front wall vertical lower section 26, a front wall arcuate middle section 28, and a front wall vertical upper section 30. As may be seen in FIGS. 2 and 3, eaves trough 12 also includes a top wall portion 32 extending inwardly from the upper marginal edge of front wall vertical upper section 30. In turn, a flange 34 extends from the distal end of top wall portion 32 downwardly and inwardly to define a recess or cavity between vertical upper section 30, top wall portion 32, and flange 34.

Gutter guard 10 is of a generally elongated configuration having a first side 38 and a second side 40. Intermediate first side 38 and second side 40 is a generally planar portion 42 having a plurality of apertures 44 formed therein.

At first side 38, planar portion 42 terminates with a first segment 46 which extends upwardly and rearwardly and forms an acute angle with respect to planar portion 42. A second segment 48 extends vertically downwardly from a distal end of first segment 46 and in turn a third segment 49 extends horizontally from a distal end of second segment 48. A fourth segment 51 extends upwardly from a distal end of third segment 49 and terminates in a curved inward portion 50 which then abuts the point of joinder of top wall portion 32 and flange 34 as may be best seen in FIG. 3. The arrangement is such that there is thus provided a double point of contact between the gutter and gutter guard to allow for support.

At second side 40, there is provided an inverted U-shaped portion generally designated by reference numeral 52 and which comprises an upwardly extending wall segment 54 which reverses through 180° to join a downwardly extending wall segment 56. As may be seen in FIGS. 2 and 3, U-shaped portion 52 fits over the upper portion of rear wall 20.

Using this arrangement, the eaves trough or gutter may be secured by driving a suitable attachment member 55 (nail or screw) through wall 54, wall 20 and wall 56 into facia 14. The interlocking arrangement of first and second sides of gutter guard 10 with the structure of the eaves trough provides rigidity and support for the front of the eaves trough to prevent sagging thereof.

Figure 2:
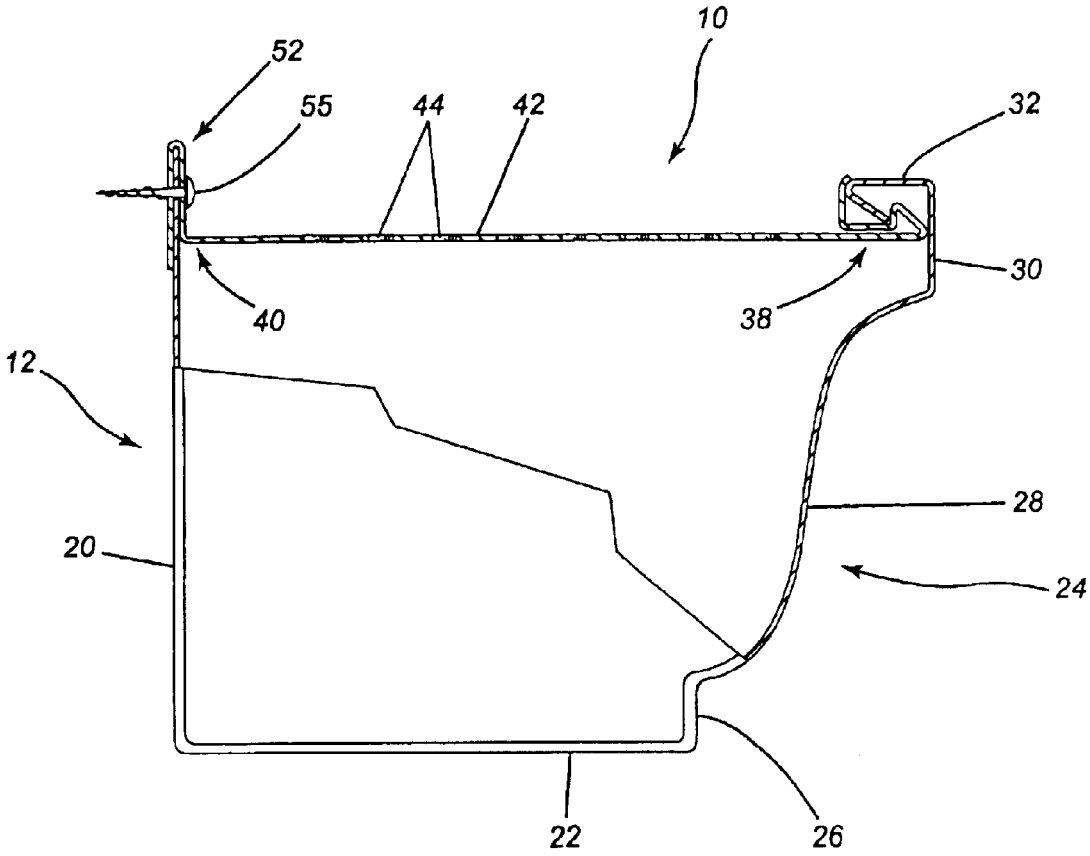
FIG. 2 is a side elevational view, partially in section, to illustrate a first embodiment of a gutter guard and its securement to a gutter.
Figure 3:
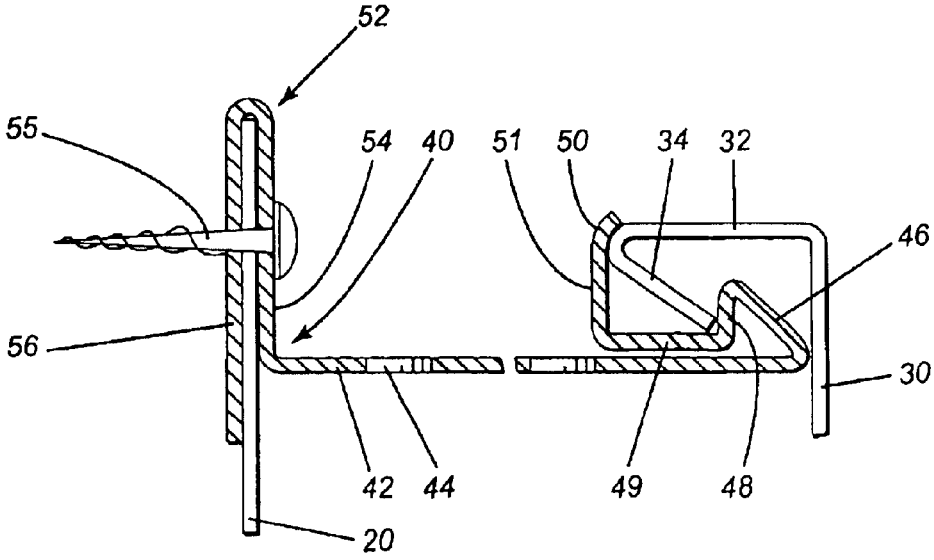
FIG. 3 is a detailed cross sectional view of the guard member portion and its securement to the gutter.
Figure 4:
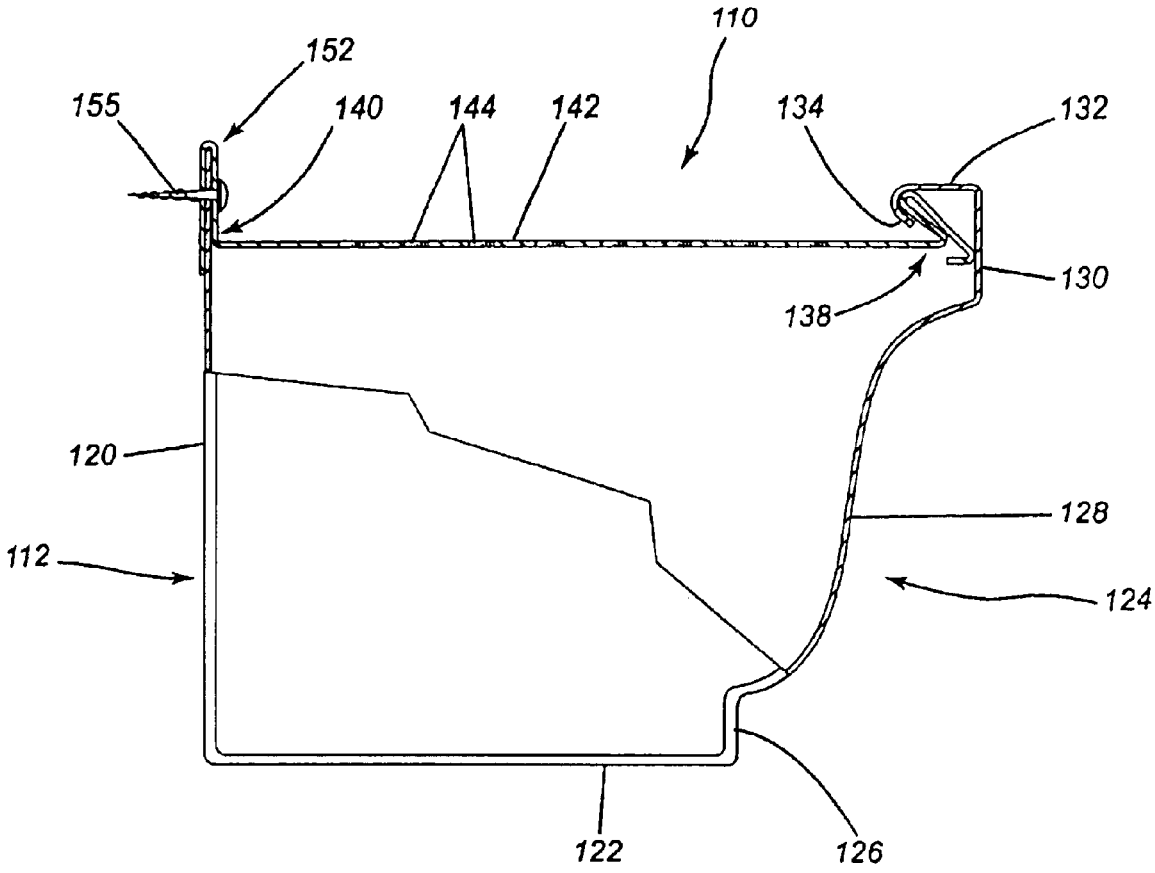
FIG. 4 is a side elevational view, partially in cut away, of a second embodiment of a gutter guard according to the present invention.
Figure 5:
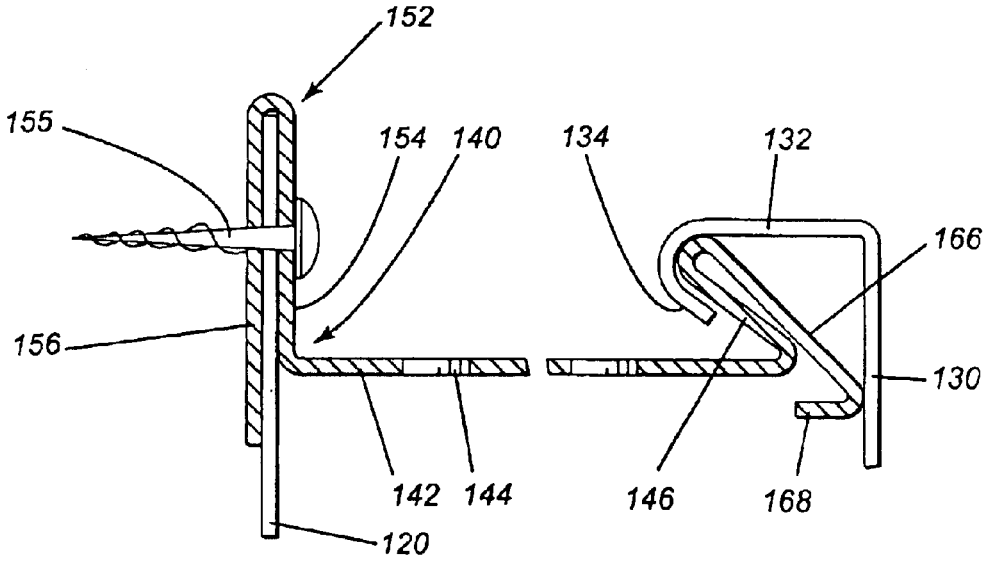
FIG. 5 is an enlarged detailed view illustrating the attachment of the guard on either side of the gutter.

In the embodiment of FIGS. 4 and 5, a modified arrangement of that shown in FIGS. 1, 2, and 3 is illustrated. As many of the components are in common, similar reference numerals in the 100's have been utilized.

The main difference with the embodiment of FIGS. 4 and 5 is the arrangement at first side 138 of gutter guard 110. In this respect, there is provided a first segment 146 similar to that previously described.

However, first segment 146 reverses itself and is connected to a second segment 166 which lies adjacent to first segment 146. Second segment 166 extends beyond first segment 146 to abut against vertical upper section 130 of front wall 124. At the distal end of second segment 166, there is provided an inwardly extending third segment 168. Again, support and rigidity are provided to the structure and it may be attached in a manner similar to that described with respect to the embodiment of FIGS. 1 to 3.

Figure 6:
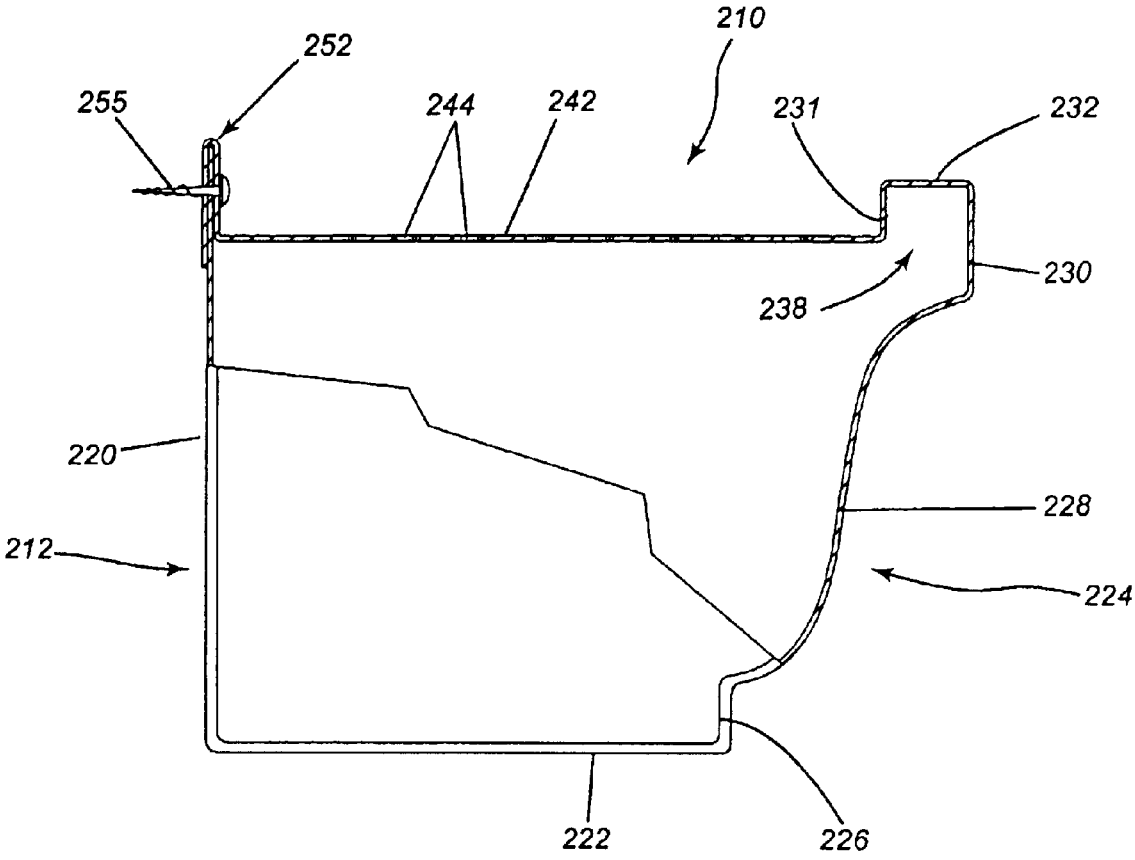
FIG. 6 is an end elevational view, partially in cut away, of a novel gutter according to the present invention.
Figure 7:
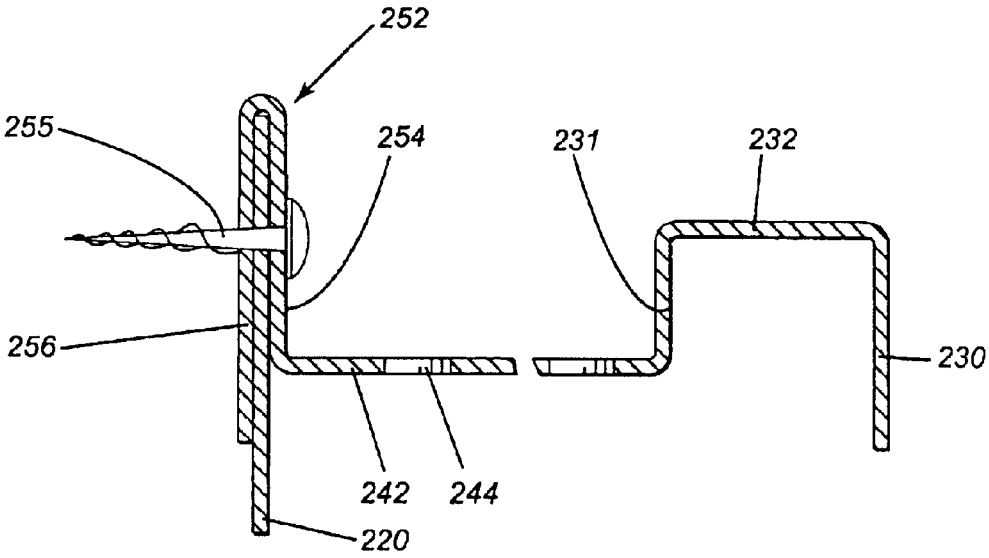
FIG. 7 is an enlarged view of the upper portion of the gutter of FIG. 6.

In the embodiment of FIGS. 6 and 7, there is provided an integrated eaves trough structure which includes a guard portion. Again, the eaves trough structure remains similar and similar reference numerals in the 200's have been employed. In this embodiment, a segment 231 extends substantially vertically downwardly from top wall portion 232 to join planar portion 242. At the second side 240 of planar portion 242, there is provided a similar inverted U-shaped structure 252. In this arrangement, the gutter and guard can be formed from a single sheet of material which is then suitably folded by conventional forming equipment. Again, the structure would be attached to the facia by means of attachment members 255 extending through the walls.

It will be understood that the above described embodiments are for purposes of illustration only and that changes or modifications may be made thereto without departing from the spirit and scope of the invention.

I claim:

1. A device for protecting a gutter wherein the gutter has a rear wall, a front wall, and a bottom wall, said walls defining a trough having an open top therebetween, said gutter also having a top wall portion extending inwardly from an upper marginal edge of said front wall, and a downwardly extending flange from a distal end of said top wall, said front wall, said top wall and said flange defining a recess therebetween, said device comprising:

a guard member having an elongated configuration with a generally planar central portion, first and second longitudinally extending opposed sides located on either side of said generally planar central portion, a plurality of apertures extending through said generally planar central portion;

said first side of said guard member having an upwardly extending portion designed to fit within stud recess, of said guard member comprising a first segment extending upwardly and rearwardly to form an acute angle with said substantially planar portion, said first segment merging with a second segment lying adjacent thereto inn 180° turn, the arrangement being such that said portion between said first and second segments abuts said too wall and said flange, and a distal end of said second segment abuts said front wall; and said second side of said guard member having an inverted U-shaped portion designed to fit over an upper marginal edge of said rear wall of said gutter.

2. The device of claim 1 wherein said apertures are arranged in diagonal rows extending between said first and second longitudinally extending opposed sides.

3. The device of claim 2 wherein said apertures are circular in configuration, said apertures having a diameter of between 2.5 and 10 mm.

4. The device of claim 3 wherein said apertures have a diameter of between 3.0 and 4.0 mm.

5. The device of claim 3 wherein said diagonal rows extend at an angle of 45° with respect to said first and second longitudinally extending opposed sides, said apertures forming longitudinally extending rows, said apertures being spaced apart by a distance of between 10 and 15 mm in said longitudinally extending rows.

6. The device of claim 5 wherein said apertures are arranged in diagonal rows extending between said first and second longitudinally extending opposed sides, said apertures having a diameter of between 3.0 and 4.0 mm, said diagonal rows extending ax an angle of 45 with respect to said first and second longitudinally extending opposed sides.

7. The device of claim 3 wherein said guard member is formed of a metallic material.

8. A device for protecting a gutter wherein the gutter has a rear wall, a front wall, and a bottom wall, said walls defining a trough having an open top therebetween, said gutter also having a top wall portion extending inwardly from an upper marginal edge of said front wall, and a downwardly extending flange from a distal end of said top wall, said front wall, said top wall and said flange defining a recess there between, said device comprising:

a guard member having an elongated configuration with a generally planar central portion, first and second longitudinally extending opposed sides located on either side of said generally planar central portion, a plurality of apertures extending through said generally planar central portion;

said first side of said guard member having an upwardly extending portion designed to fit within said recess said upwardly extending portion from said first side of said guard member comprising a first segment extending upwardly and rearwardly forming an acute angle with said substantially planar portion, a second segment extending substantially vertically downwardly, and a third segment extending from a distal end of said second segment in a substantially horizontal direction parallel to said substantially planar portion, the arrangement being such that said downwardly extending flange from said top wall of said gutter abuts said second and third segments.

9. In a building having a gutter for collecting water, the improvement wherein said gutter has a rear wall, a front wall, and a bottom wall, said walls defining an open trough therebetween, said gutter also having atop wall portion extending inwardly from an upper marginal edge of said front wall, and a downwardly extending flange from a distal end of said top wall, said front wall, said top wall and said flange defining a recess therebetween;

a guard member having an elongated configuration with a generally planar central portion, first and second longitudinally extending opposed sides located on either side of said generally planar central portion, a plurality of apertures extending through said generally planar central portion;

said first side of said guard member having an upwardly extending portion designed to fit within said recess;

said second side of said guard member having an inverted U-shaped configuration fitting over an upper marginal edge of said rear wall of said gutter; and said gutter being attached by a fastening means extending through said inverted U-shaped portion and said rear wall of said gutter to said building structure.

10. The improvement of claim 9 wherein said upwardly extending portion from said first side of said guard member comprises a first segment extending upwardly and rearwardly to form an acute angle with said substantially planar portion, said first segment merging with a second segment lying adjacent thereto in a 180° turn, the arrangement being such that said portion between said first and second segments abuts said top wall and said flange, and a distal end of said second segment abuts said front wall.

11. The improvement of claim 9 wherein said upwardly extending portion from said first side of said guard member comprises a first segment extending upwardly and rearwardly forming an acute angle with said substantially planar portion, a second segment extending substantially vertically downwardly, a third segment extending from a distal end of said second segment in a substantially horizontal direction parallel to said substantially planar portion, the arrangement being such that said downwardly extending flange from said top wall of said gutter abuts said second and third segments.

* * * * *